United States Patent [19]

Rao

[11] 4,445,486

[45] May 1, 1984

[54] INTERNAL COMBUSTION ENGINE

[75] Inventor: Nidadavolu N. N. Rao, Pune, India

[73] Assignee: Kirloskar Oil Engines Limited, Khadki, Pune, India

[21] Appl. No.: 536,823

[22] Filed: Sep. 28, 1983

Related U.S. Application Data

[63] Continuation of Ser. No. 392,653, Jun. 28, 1982, abandoned, which is a continuation of Ser. No. 40,431, May 18, 1979, abandoned.

[51] Int. Cl.[3] ..... F02M 31/00

[52] U.S. Cl. ..... 123/557; 123/41.42; 123/41.69

[58] Field of Search ..... 123/557, 41.42, 41.56, 123/41.57, 41.69, 41.3, 558, 193 P, 193 C, 193 CD

[56] References Cited

U.S. PATENT DOCUMENTS

| | | | |
|---|---|---|---|
| 554,586 | 8/1895 | Mead | 123/557 |
| 679,410 | 7/1901 | Birdsall | 123/41.57 |
| 701,140 | 5/1882 | Briggs | 123/557 |
| 741,824 | 10/1903 | Pehrsson | 123/557 |
| 742,799 | 10/1903 | Ostergren | 123/557 |
| 1,104,968 | 7/1914 | Crothers | 123/557 |
| 1,124,157 | 1/1915 | Low | 123/557 |
| 1,309,985 | 7/1919 | Jay | 123/557 |
| 1,386,544 | 8/1921 | Wolff | 123/41.42 |
| 1,423,365 | 7/1922 | Smith | 123/41.42 |
| 1,683,268 | 9/1928 | Streeter | 123/557 |
| 2,190,394 | 2/1940 | Birkigt | 123/41.57 |
| 2,298,214 | 10/1942 | Jones | 123/557 |
| 2,765,779 | 10/1956 | Graves | 123/41.57 |
| 3,063,435 | 11/1962 | Meurer et al. | 123/41.57 |
| 3,765,384 | 10/1973 | Barnard | 123/41.57 |

*Primary Examiner*—Ronald H. Lazarus

*Attorney, Agent, or Firm*—Bucknam and Archer

[57] ABSTRACT

The invention relates to an improved internal combustion engine having an air cooled or liquid cooled cylinder head and a piston of low thermal conductivity and low thermal expansion material and a uniform clearance between the cylinder liner and piston around the circumference, the cylinder liner being provided with fins for cooling by natural convection in order to avoid loss of heat from the combustion chamber to the coolant for increased efficiency of the engine.

2 Claims, 2 Drawing Figures

INTERNAL COMBUSTION ENGINE

Figure 1:
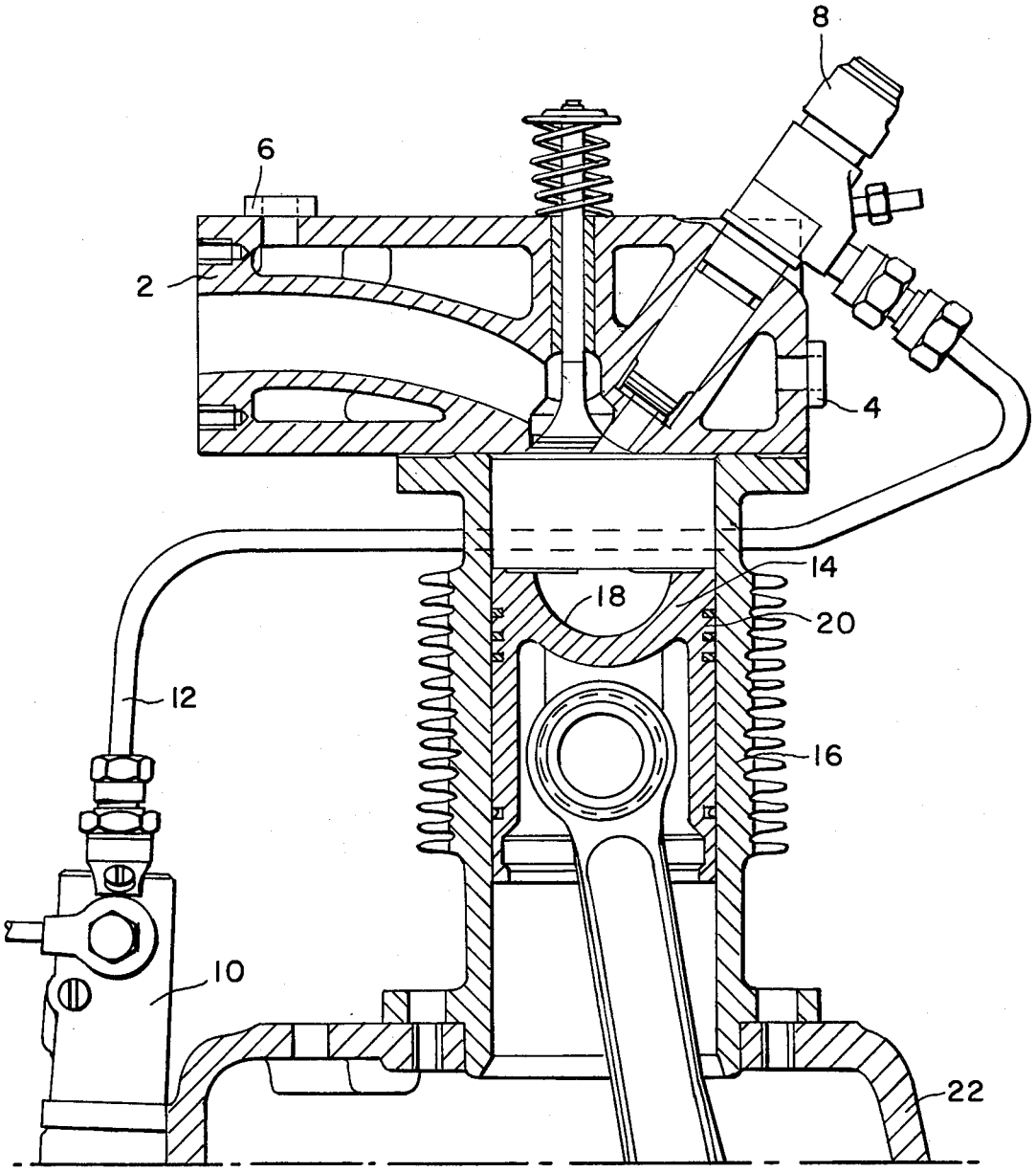

This application is a continuation of application Ser. No. 392,653, filed June 28, 1982, now abandoned which is a continuation of application Ser. No. 040,431, filed May 18, 1979, now abandoned.

This invention relates to an improved internal combustion engine which may be of the air cooled type or the liquid cooled type.

In air-cooled internal combustion engines, the cylinder head and the cylinder liner are provided with fins or such extended surfaces through which a blast of cooling air is forced by means of a fan or blower. In liquid-cooled internal combustion engines, the cylinder head and the cylinder liner are provided with jackets through which water or such liquid is forced by means of a pump. The cylinder head requires to be cooled to maintain the temperature of the valves, nozzles and lower part of the cylinder head below their permissible values. The cylinder liner requires to be cooled to maintain the temperature of the piston and the lubricating oil between the piston and the cylinder liner below their permissible values. The piston is commonly made of aluminium. If the temperature of an aluminium piston exceeds 300° C., it tends to expand and seize in the liner. If the temperature of the lubricating oil exceeds 220°-250° C., it burns off to form resins and varnishes and causes ring sticking. Rarely, the piston is also made of iron alloy. Such piston can withstand temperature upto 450°-500° C. without significant loss of strength.

A disadvantage of such internal combustion engine is that part of the heat being produced in the combustion chamber is lost to the coolant with the result fuel consumption increases and efficiency of the engine decreases.

A further disadvantage of such internal combustion engine is that there are chances of the lubricating oil getting overcooled with the result the piston friction increases and consequently fuel consumption increases and efficiency of the engine decreases.

A still further disadvantage of such internal combustion engine is that in the case of compression ignition internal combustion engine low grade or low cetane fuels such as light diesel oil, crude oil or furnace oil can not be burnt efficiently because of their high viscosity.

Another disadvantage of such internal combustion engine is that clearance between the piston and the cylinder liner is comparatively more and varies along the piston pin axis and across the piston pin axis with the result lubricating oil between the cylinder liner and the piston is comparatively more and its thickness is uneven and it requires considerable coolant to get itself cooled.

An object of the invention is to obviate the aforesaid disadvantages and provide an improved internal combustion engine wherein the cylinder liner is cooled by natural convection.

A further object of the invention is to provide an improved internal combustion engine which burns low grade or low cetane fuels efficiently.

A still further object of the invention is to provide an improved internal combustion engine wherein clearance between the cylinder liner and the piston is uniform around the circumference and is less than that of a conventional internal combustion engine of equivalent size and speed so that comparatively less coolant is required to cool the lubricating oil between the cylinder liner and the piston.

Another object of the invention is to provide an improved internal combustion engine which consumes comparatively less fuel and is comparatively more efficient.

The invention provides an improved internal combustion engine wherein the cylinder head is air cooled or liquid cooled and the piston is made of materials of low thermal conductivity and low thermal expansion such as cast iron or cast steel characterised in that the clearance between the cylinder liner and the piston is uniform around the circumference and is less than that of a conventional internal combustion engine of equivalent size and speed and the cylinder liner is provided with fins or such extended surfaces to cool the cylinder liner, the lubricating oil and the piston by natural convection.

In the improved internal combustion engine, cooling by natural convection maintains the temperature of the lubricating oil below 220°-250° C. and the temperature of the piston crown upto 450°-500° C. The high temperature of the piston crown facilitates efficient combustion of the fuel and reduces specific fuel consumption of the engine. In the case of compression ignition internal combustion engine, the high temperature of the piston crown reduces delay period and ensures that the rate of pressure rise is comparatively less so as to render the engine smooth and vibration free.

The fins may be perpendicular to or parallel to the cylinder liner axis.

The cylinder liner may be made of aluminium, cast iron or cast steel.

According to an embodiment, wherein the internal combustion engine is of liquid cooled compression ignition type circulation means may be provided for circulating low grade or low cetane fuels through the cooling jacket of the cylinder head prior to feeding the said fuel to the fuel injection pump and thence to the fuel injection nozzle.

Preferably, the circulation means may comprise a flow pipe connecting the fuel tank of the said engine and coolant inlet of the said jacket, one or more fuel filters provided with the flow pipe and a return pipe connecting the coolant outlet of the said jacket to the said fuel tank and also to the fuel injection pump of the said engine.

Figure 2:
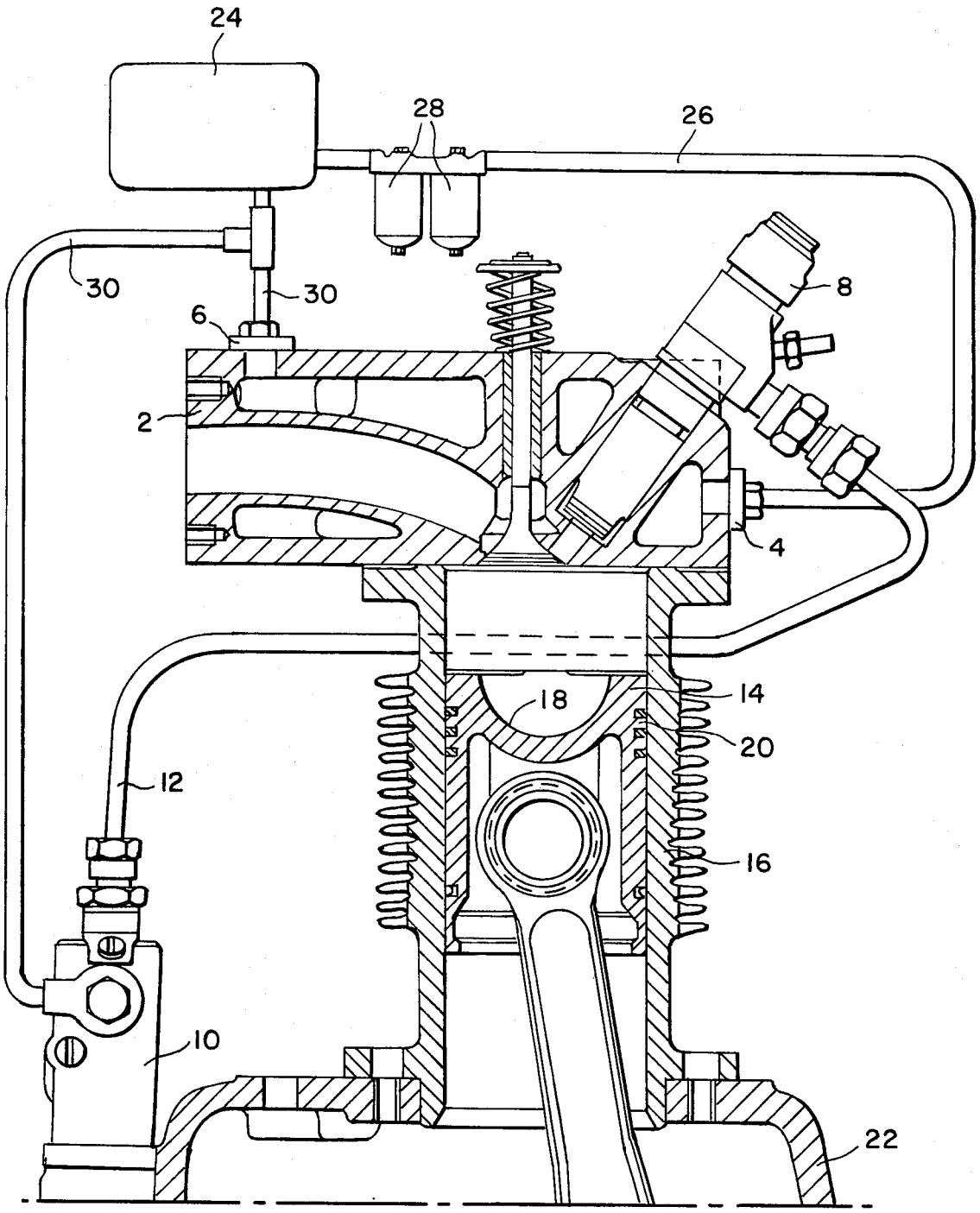

The invention will now be described, by way of example, with reference to the accompanying drawings, in which:

FIG. 1 is a cross-sectional view of the upper part of a compression ignition internal combustion engine in accordance with an embodiment of the invention, and FIG. 2 is a cross-sectional view of the upper part of a compression ignition internal combustion engine in accordance with another embodiment of the invention.

In FIGS. 1 and 2 like reference numerals indicate identical parts.

Referring to FIG. 1, the internal combustion engine is a liquid-cooled type and consists of a liquid-cooled cylinder head 2 having a coolant inlet 4 and a coolant outlet 6 and a fuel injection nozzle 8 connected to a fuel-injection pump 10 via a high pressure pipe 12. The engine also has a piston 14 made of cast iron or cast steel adapted to operatively move in a cylinder liner 16 which may be made of cast iron or cast steel or even aluminium. The crown of the piston is marked 18 and the piston ring zone is marked 20. The cylinder liner 16 is fitted with fins which cool the cylinder liner, lubricating oil and the piston by natural convection. The clearance between the cylinder liner and the piston is uniform around the circumference. The crank case assembly marked 22 is of any conventional construction.

The cylinder head may be air cooled instead of being liquid cooled in which case a blast of air is forced through fins or such extended surfaces provided in the cylinder head by a fan or blower. In this case, the duct through which air is blown will be connected to the air inlet of the cylinder head. The air will flow in through the air inlet of the cylinder head and flow out through the air outlet of the cylinder head.

FIG. 2 shows another embodiment which is identical to that shown in FIG. 1 except that it has additionally a circulation means consisting of a flow pipe 26 (provided with fuel filters 28) connecting the fuel tank 24 of the said engine to the coolant inlet 4 and a return pipe 30 connecting the coolant outlet 6 to the fuel tank 24 and also to the fuel injection pump 10. From the fuel tank, part of the fuel which is a low grade or low cetane fuel, enters the cylinder head through the flow pipe and the coolant inlet and goes to the fuel injection pump through the coolant outlet and the return pipe after taking away heat of the cylinder head along with it. As can be seen, part of the fuel from the fuel tank enters the fuel injection pump through the return pipe directly. Fuel that is coming from the cylinder head and that is coming from the fuel tank directly gets mixed up. Temperature of the mixed up fuel being higher than that of the fuel in the fuel tank its viscosity is less and it flows faster.

The following is a comparative study of the conventional internal combustion engine and the improved internal combustion engine:

| Conventional internal combustion engine | Improved internal combustion engine |
|---|---|
| 1. the cylinder liner and the piston and the lubricating oil between the cylinder liner and the piston are cooled by circulating liquid through a jacket provided on the cylinder liner or by blowing air through fins or such extended surfaces provided on the cylinder liner by a fan or blower. | 1. the cylinder liner and the piston and the lubricating oil between the cylinder liner and the piston are cooled by natural convection. |
| 2. since the clearance between the cylinder liner and the piston varies along the piston pin axis and across the piston axis and is comparatively more lubricating oil in the clearance is comparatively more, its thickness is uneven and it requires more coolant to get itself cooled. | 2. since the clearance between the cylinder liner and the piston is uniform around the circumference and is comparatively less lubricating oil required is less and cooling required is less. |
| 3. since the clearance between the cylinder liner and the piston is comparatively more leakage of blowby gas past the piston and piston rings into the crank case is comparatively more. | 3. since the clearance between the cylinder liner and the piston is comparatively less, leakage of blowby gas past the piston and piston rings into the crank case is comparatively less. |
| 4. the fuel is not being used as a coolant to cool the cylinder head. | 4. the fuel can be used as a coolant to cool the cylinder head in which case no additional coolants such as water or air would be required to cool the cylinder head. |
| 5. low grade or low cetane fuel cannot be burnt efficiently. | 5. low grade or low cetane fuel can be burnt efficiently. |
| 6. the fuel consumption is comparatively more. | 6. the fuel consumption is comparatively less. |
| 7. comparatively less efficient. | 7. comparatively more efficient. |

In this specification, wherever the word 'comparatively' is used it is to be understood that comparison is between an improved internal combustion engine of a particular size and speed and a conventional internal combustion engine of equivalent size and speed.

We claim:

1. An improved internal combustion engine, comprising a fuel System, a cylinder, said cylinder including a cylinder liner portion and a cylinder head, said cylinder head including cooling passage therein, said cylinder head being cooled by a single fluid, a piston movable within said cylinder, the outer portion of said cylinder comprising an upper, a middle and a lower portion, cooling fins positioned on the middle portion only, the clearance between the piston and the cylinder liner being an amount which allows adequate cooling of the cylinder liner, engine lubricating oil, and piston solely by natural convection, said clearance being uniform around the confronting circumference of said piston and cylinder, said fuel system comprising a fuel source, a fuel injection pump, an injection nozzle mounted in the cylinder head, a first fuel line means extending between the pump and the fuel injection nozzle, and a second fuel line means providing fluid communication among the fuel source, said cooling passages, and said fuel injection pump for said fuel prior to its being supplied to said first fuel line means, whereby the fuel acts as a coolant to cool the cylinder head.

2. An improved internal combustion engine according to claim 1, wherein said piston is made of cast iron.

* * * * *